US011976558B2

(12) United States Patent
Wu et al.

(10) Patent No.: US 11,976,558 B2
(45) Date of Patent: May 7, 2024

(54) MECHANICAL TUNNELING APPARATUS AND PROCESS FOR TUNNEL IN QUICKSAND STRATUM

(71) Applicant: Shandong University, Jinan (CN)

(72) Inventors: Ke Wu, Jinan (CN); Dapeng Liu, Jinan (CN); Wenbin Xu, Jinan (CN); Yajun Liu, Jinan (CN); Zhongyu Dou, Jinan (CN); Zhenhua Liu, Jinan (CN)

(73) Assignee: Shandong University, Jinan (CN)

( * ) Notice: Subject to any disclaimer, the term of this patent is extended or adjusted under 35 U.S.C. 154(b) by 0 days.

(21) Appl. No.: 18/460,340

(22) Filed: Sep. 1, 2023

(65) Prior Publication Data

US 2023/0417139 A1 Dec. 28, 2023

Related U.S. Application Data

(63) Continuation of application No. PCT/CN2021/093235, filed on May 12, 2021.

(30) Foreign Application Priority Data

Apr. 15, 2021 (CN) ..... 202110403763.0

(51) Int. Cl.
*E21D 9/00* (2006.01)
*E21D 9/04* (2006.01)
(Continued)

(52) U.S. Cl.
CPC ..... *E21D 9/001* (2013.01); *E21D 9/04* (2013.01); *E21D 9/0664* (2016.01);
(Continued)

(58) Field of Classification Search
CPC ..... E21D 9/0664; E21D 9/001; E21D 9/04; E21D 9/0607; E21D 9/0642; E21D 9/0671; E21D 9/0678; E21D 9/087; E21D 9/124
See application file for complete search history.

(56) References Cited

U.S. PATENT DOCUMENTS 4,167,289 A * 9/1979 Ono ..... E21D 9/0879 299/33
2023/0193758 A1* 6/2023 Jordan ..... E21D 9/0671
2023/0272674 A1* 8/2023 Anzai ..... E21D 9/0678 175/393

FOREIGN PATENT DOCUMENTS

CN 1982650 A 6/2007
CN 102733815 A 10/2012
(Continued)

OTHER PUBLICATIONS

Internation Search Report of PCT/CN2021/093235, Mailed Dec. 23, 2021.

*Primary Examiner* — Nicole Coy
*Assistant Examiner* — Michael A Goodwin

(57) ABSTRACT

The present invention relates to a mechanical tunneling apparatus and process for a tunnel in a quicksand stratum. The mechanical tunneling apparatus comprises isolating apparatuses arranged at an upper end and a lower end of a supporting apparatus; an excavation apparatus arranged at a front end of the supporting apparatus; a spraying apparatus arranged on the isolating apparatuses and the excavation apparatus; a muck discharging apparatus arranged at a lower part of the supporting apparatus; and a propulsion apparatus arranged at a rear end of the supporting apparatus.

7 Claims, 6 Drawing Sheets

(51) Int. Cl.
*E21D 9/06* (2006.01)
*E21D 9/087* (2006.01)
*E21D 9/12* (2006.01)

(52) U.S. Cl.
CPC ..... *E21D 9/0678* (2016.01); *E21D 9/087* (2013.01); *E21D 9/124* (2013.01); *E21D 9/0671* (2016.01)

(56) References Cited

FOREIGN PATENT DOCUMENTS

| | | | | |
|---|---|---|---|---|
| CN | 106499406 | A | | 3/2017 |
| CN | 107218048 | A | | 9/2017 |
| CN | 111550255 | A | | 8/2020 |
| JP | 1181847 | A | | 3/1999 |
| JP | 2017227094 | A | | 12/2017 |
| KR | 20160004884 | A | * | 1/2016 |

* cited by examiner

MECHANICAL TUNNELING APPARATUS AND PROCESS FOR TUNNEL IN QUICKSAND STRATUM

CROSS-REFERENCE TO RELATED APPLICATIONS

The present application is a continuation of PCT application PCT/CN2021/093235 entitled "mechanical tunneling apparatus for tunnel in quicksand stratum, and process" filed on May 12, 2021, which claims priority of Chinese patent application CN202110403763.0, filed on Apr. 15, 2021, the entire contents of which are incorporated herein by reference.

TECHNICAL FIELD

The present invention belongs to the technical field of underground engineering, and particularly relates to a mechanical tunneling apparatus and process for a tunnel in a quicksand stratum.

BACKGROUND

With the development of transportation power construction of China, the scale of urban subway tunnel construction continues to expand, and tunnel construction inevitably passes through a quicksand stratum area. As is known to all, a steel structure may be inserted into a natural quicksand stratum under the action of external force. Meanwhile, excavation disturbance of a tunnel is very prone to causing a large volume of collapse, and it is difficult to form a stable surrounding rock mass. Once an initial stress state of the quicksand stratum changes, it is very prone to causing collapse of a sand layer, endangering the life safety of a constructor.

However, in the prior art, a traditional construction process for a tunnel in a quicksand stratum usually adopts a reinforcement method of "advanced small pipe+large pipe shed+radial grouting". Such construction process has the disadvantages of high construction cost and long time consumption. Moreover, it is prone to causing disturbance and then a large volume of collapse of the quicksand stratum during tunnel construction, thereby affecting a tunneling speed and safety of the tunnel.

SUMMARY

In order to solve the above problems in the prior art, the present invention provides a mechanical tunneling apparatus for a tunnel in a quicksand stratum. The mechanical apparatus of the present invention may effectively increase a tunneling speed and safety for the tunnel in the quicksand stratum, ensure the stability of surrounding rocks of the tunnel, and reduce a large volume of collapse of the quicksand stratum due to tunnel construction disturbance.

To achieve the above objective, the present invention adopts the following technical solutions:

A mechanical tunneling apparatus for a tunnel in a quicksand stratum includes a supporting apparatus, isolating apparatuses, an excavation apparatus, a spraying apparatus, a muck discharging apparatus and a propulsion apparatus, wherein the isolating apparatuses are arranged at an upper end and a lower end of the supporting apparatus, and used for isolating a quicksand stratum in an excavation area from that in a non-excavation area;

the excavation apparatus is arranged at a front end of the supporting apparatus, and used for excavating and collecting quicksands of an excavation surface of the quicksand stratum;

the spraying apparatus is arranged on the isolating apparatus and the excavation apparatus, and used for pouring expansive soil slurry into the quicksand stratum;

the muck discharging apparatus is arranged at a lower part of the supporting apparatus, and used for conveying muck collected by the excavation apparatus out of the tunnel; and the propulsion apparatus is arranged at a rear end of the supporting apparatus, and used for pushing the tunneling apparatus forward.

Preferably, the isolating apparatus includes the circular shield; the circular shield has an outer diameter of 6.77 m, an inner diameter of 6.70 m and a length of 2.00 m; and a plurality of spraying ports are formed between the outer diameter and the inner diameter, to be used for spraying the expansive soil slurry. The isolating apparatuses may be inserted into the quicksand stratum in advance to isolate stress and strain transfer between the quicksand strata in the excavation area and the non-excavation area;

Preferably, the propulsion apparatus is arranged at the rear end of the circular shield; the propulsion apparatus includes a rear duct piece and a jack; and the rear duct piece is pushed forward by the jack to apply the propulsive force, so as to push the tunneling apparatus forward. The propulsion apparatus is identical to a shield machine.

Preferably, the excavation apparatus includes a cutterhead and a drive apparatus; the cutterhead is provided with a plurality of excavator bucket type cutters; the excavator bucket type cutters communicate with an interior of the cutterhead; the drive apparatus includes a rotating bearing; one end of the rotating bearing is connected with the cutterhead; the other end of the rotating bearing is connected with a power apparatus; the rotating bearing may drive the cutterhead to rotate under the driven of the power apparatus. The excavation surface of the quicksand stratum is effectively segmented using the conical cutterhead, and the quicksands are excavated and collected using the excavator bucket type cutters. The excavator bucket type cutters communicate with the cutterhead, and the excavator bucket type cutters may make the excavated quicksands enter the cutterhead for collection during excavation.

Preferably, the cutterhead is conical, having a bottom diameter of 6.65 m and a height of 1.0 m; and the excavator bucket type cutters are distributed on the conical cutterhead in a cruciform arrangement, and distributed in 4 rings in total with an interval between two rings being 1.0 m.

Preferably, an upper end and a lower end of the cutterhead are embedded into a groove on an inner surface of the shield; a certain gap is formed between the cutterhead and the shield; and the fine brushes are arranged between the cutterhead and the shield. Through sealing with the fine brushes, the quicksands are prevented from blocking the gap.

Preferably, the spraying apparatus includes a conveying pipeline and spraying ports, and an inner surface and an outer surface of the shield and the interior of the cutterhead are all provided with the spraying ports. The expansive soil slurry may be poured into the quicksand stratum using the spraying ports formed in the inner surface and the outer surface of the shield, so as to make the quicksands outside the tunneling apparatus and inside the shield be reinforced and stabilized without being disturbed and destroyed. The expansive soil slurry may be poured into the conical cutterhead using the spraying ports inside the cutterhead, so as to make the tunneled quicksand muck in the conical cutterhead be formed, which is convenient to collect and transport the quicksand muck outside the tunnel through a muck discharging system.

Preferably, the fine brushes are arranged at the spraying ports for preventing the quicksands from blocking the spraying ports.

Preferably, the muck discharging apparatus includes a screw conveyor arranged in the cutterhead; and a belt conveyor is arranged at an end of the screw conveyor. The muck in the cutterhead may be conveyed onto the belt conveyor by the screw conveyor, and then transported outside the tunnel.

The present invention further discloses a mechanical tunneling process for a tunnel in a quicksand stratum, using any one of the above mechanical tunneling apparatuses for the tunnel in the quicksand stratum for construction, and specifically including the following process steps:

(1) pushing a rear duct piece by a jack to apply propulsive force, pushing the tunneling apparatus forward in turn, and inserting a circular shield into the quicksand stratum in advance to isolate stress and strain transfer between the quicksand strata in the excavation area and the non-excavation area;

(2) pouring, by using the spraying apparatus, the expansive soil slurry into the quicksand stratum from the spraying ports on the inner surface and the outer surface of the shield, so as to make quicksands outside the tunneling apparatus and inside the shield be reinforced and stabilized without being disturbed and destroyed;

(3) driving the cutterhead by the drive apparatus to rotate, effectively segmenting the excavation surface of the quicksand stratum using the conical cutterhead, and excavating and collecting the quicksands using the excavator bucket type cutters, wherein the excavator bucket type cutters communicate with the cutterhead, and the excavator bucket type cutters are capable of making the excavated quicksands enter the cutterhead for collection during excavation;

(4) spraying, by the spraying apparatus, the expansive soil slurry into the cutterhead from the spraying ports inside the cutterhead, so as to make the tunneled quicksand muck in the cutterhead be formed; and (5) conveying, by a screw conveyor, the muck in the cutterhead onto a belt conveyor, and then transporting the muck outside the tunnel.

Beneficial Effects

Based on a shield tunneling method and a theory of steel structure mechanics, the present invention proposes a mechanical apparatus suitable for tunneling construction in the quicksand stratum. The mechanical apparatus includes the circular shield, the conical cutterhead, the spraying apparatus, the muck discharging apparatus, and the propulsion apparatus. The circular shield may be inserted into the quicksand stratum in advance to isolate stress and strain transfer between the quicksand strata in the excavation area and the non-excavation area. The conical cutterhead uses a cone to effectively segment the excavation surface of the quicksand stratum, and uses the excavator bucket type cutters at an upper part of the cone to excavate and collect the quicksands. The spraying apparatus pours the expansive soil slurry into the quicksand stratum by virtue of the spraying ports formed in the circular shield and the conical cutterhead, so as to make the quicksands outside the tunneling apparatus and inside the circular shield be reinforced and stabilized without being disturbed and destroyed; and therefore, the tunneled quicksand muck in the conical cutterhead be formed, which is convenient to collect and transport the quicksand muck outside the tunnel through the muck discharging system. The muck discharging apparatus conveys the muck onto the belt conveyor by the screw conveyor, and then transports the muck outside the tunnel. The propulsion apparatus, being identical to a shield machine, acts on the rear duct piece, and pushes the rear duct piece forward by the jack to apply the propulsive force, so as to push the tunneling apparatus forward.

The mechanical apparatus of the present invention may effectively increase a tunneling speed and safety for the tunnel in the quicksand stratum, ensure the stability of surrounding rocks of the tunnel, reduce collapse of the quicksand stratum due to tunnel construction, reduce the engineering construction cost and increase the engineering construction speed.

Figure 1:
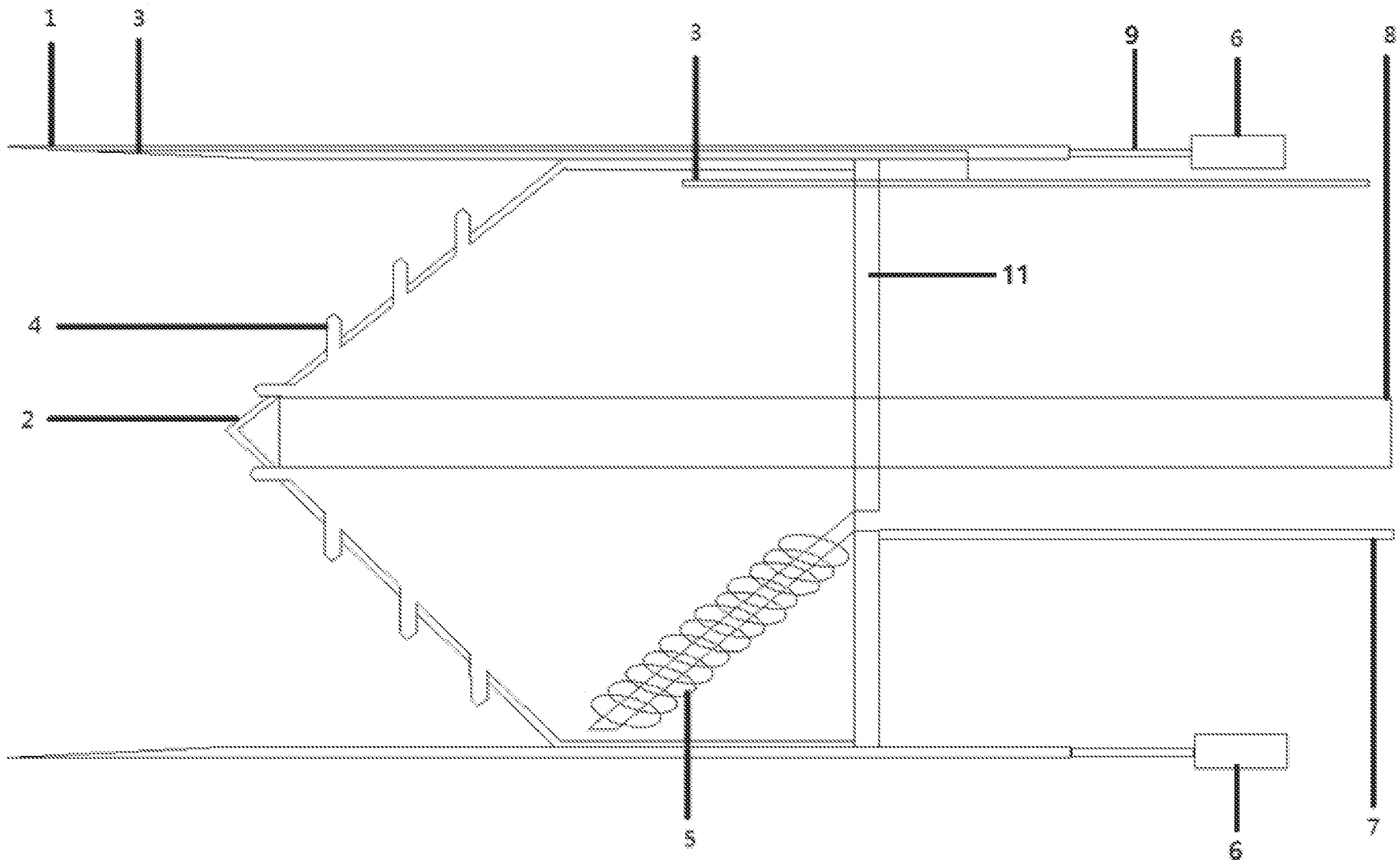
FIG. 1 is a schematic structural working diagram of a mechanical tunneling apparatus for a tunnel in a quicksand stratum.

Reference numerals in the drawings: 1. circular shield, 2. conical cutterhead, 3. spraying apparatus, 4. excavator bucket type cutter, 5. screw conveyor, 6. jack, 7. belt conveyor, 8. rotating bearing, 9. rear duct piece, 10. fine brush, and 11. supporting apparatus.

DETAILED DESCRIPTION OF THE EMBODIMENTS

The present invention will be described in detail below. Before the description, it should be understood that the terms used in the specification and the accompanying claims should not be construed as limited to general meaning and dictionary meaning, but should be interpreted according to the corresponding meanings and concepts of the technical aspects of the present invention on the basis of the principle of allowing the inventor to properly define the terms for optimal interpretation. Therefore, the description presented here is merely a preferred example for an illustrative purpose, and is not intended to limit the scope of the present invention, and it should be understood that, without departing from the spirit and the scope of the present invention, other equivalents or modifications can be obtained therefrom.

The following embodiments are merely listed as examples of the implementations of the present invention, and do not suggest any limitation as to the present invention. Those skill in the art can understand that all the alterations without departing from the scope of the essence and conception of the present invention fall within the scope of the protection of the present invention. Unless otherwise specified, the reagents and the instruments used in the following embodiments are all commercially available products.

Embodiment 1

Figure 2:
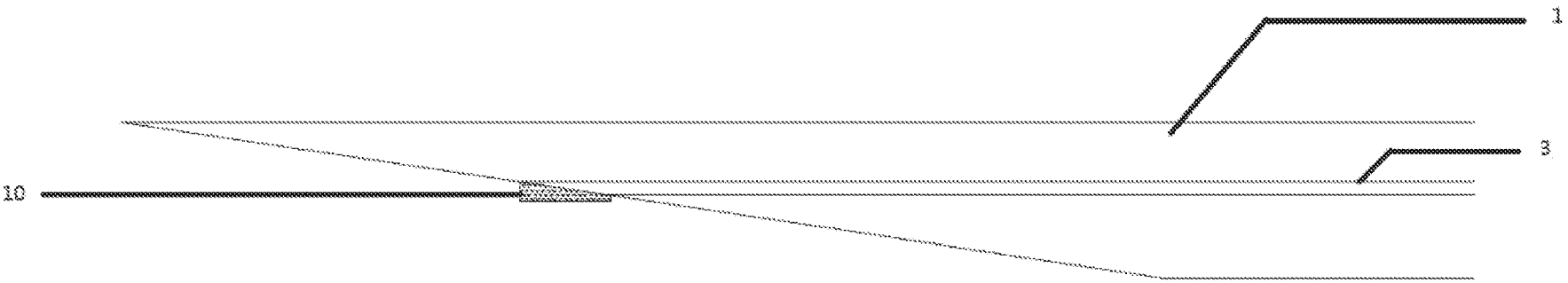
FIG. 2 is a schematic diagram of a longitudinal structure of a circular shield and a spraying apparatus.
Figure 3:
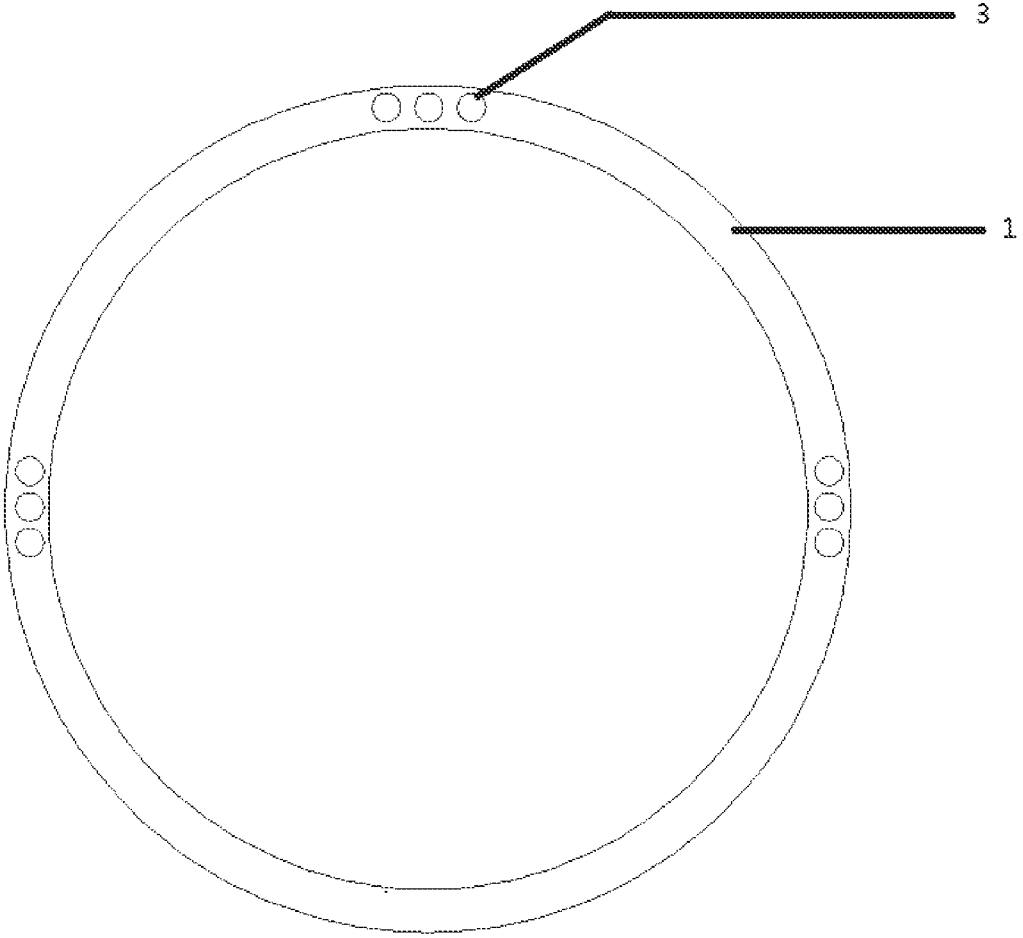
FIG. 3 is a schematic diagram of a transverse structure of a circular shield and a spraying apparatus.
Figure 4:
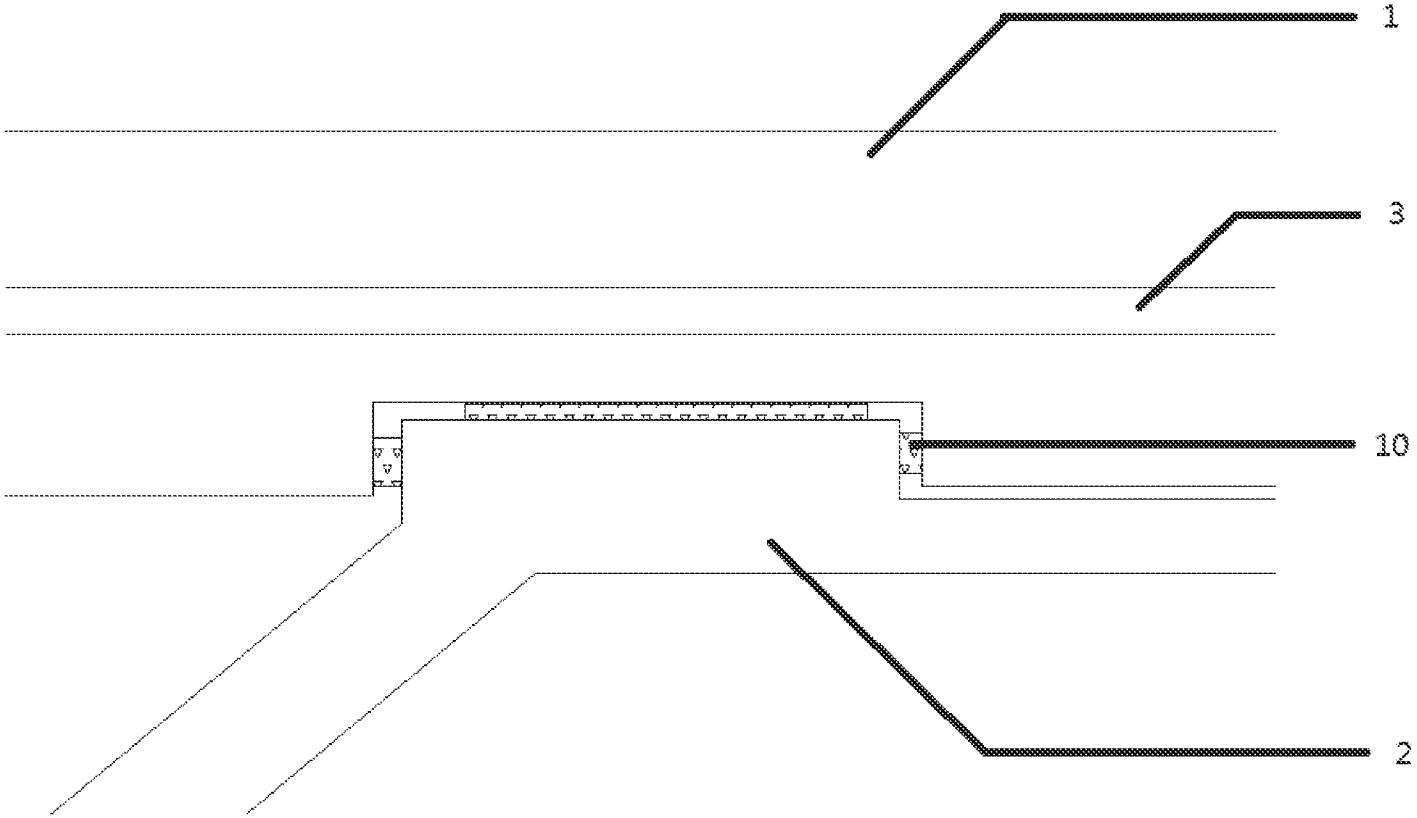
FIG. 4 is a schematic diagram of a longitudinal structure of a conical cutterhead.
Figure 5:
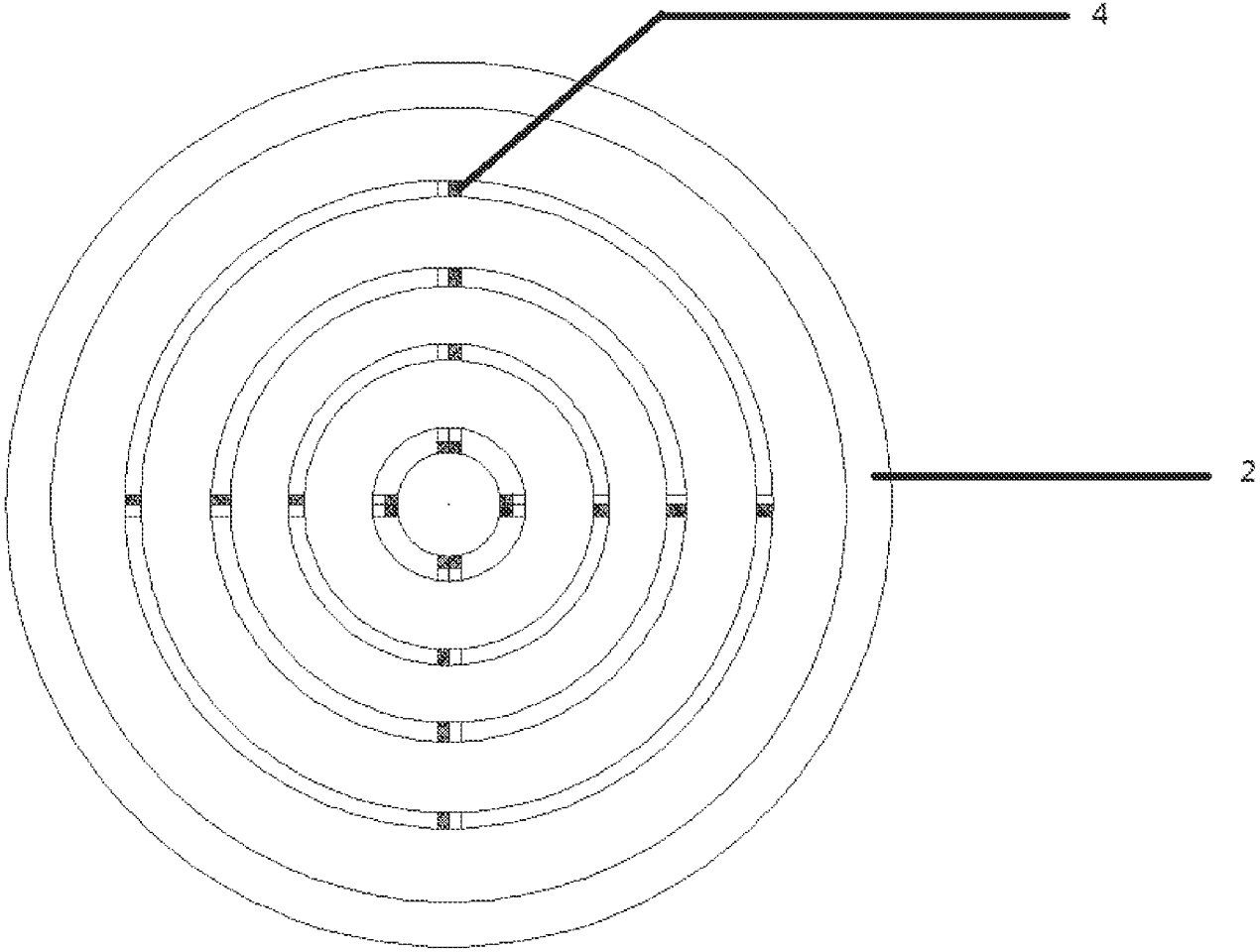
FIG. 5 is a schematic diagram of a transverse structure of a conical cutterhead.
Figure 6:
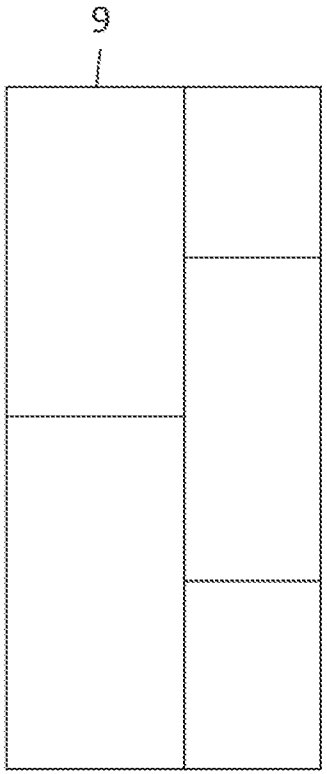
FIG. 6 is a schematic structural diagram of a rear duct piece.

As shown in FIGS. 1-6, a mechanical apparatus suitable for tunneling construction of a tunnel in a quicksand stratum mainly includes a circular shield 1, a conical cutterhead 2, a spraying apparatus 3, a muck discharging apparatus (a screw conveyor 5 and a belt conveyor 7), and a propulsion apparatus (a jack 6 and a rotating bearing 8). The circular shield 1 is inserted into the quicksand stratum in advance to isolate stress and strain transfer between quicksand strata in an excavation area and a non-excavation area. The conical cutterhead 2 uses a cone to effectively segment an excavation surface of the quicksand stratum, and uses excavator bucket type cutters 4 at an upper part of the cone to excavate and collect the quicksands. Expansive soil slurry is poured into the quicksand stratum by virtue of the spraying apparatus 3 in the circular shield 1 and the conical cutterhead 2, so as to make the quicksands outside the tunneling apparatus and inside the circular shield be reinforced and stabilized without being disturbed and destroyed; and therefore, the tunneled quicksand muck in the conical cutterhead 2 be formed, which is convenient to collect and transport the quicksand muck outside the tunnel through a muck discharging system, where ports of the spraying apparatus are provided with fine brushes 10 for preventing quicksands from blocking spraying ports. The muck is conveyed onto the belt conveyor 7 by the screw conveyor 5, and then transported outside the tunnel. By acting on a rear duct piece 9, and pushing the rear duct piece 9 forward by the jack 6 to apply propulsive force, the tunneling apparatus is pushed forward; and the conical cutterhead 2 is driven by rotation of the rotating bearing 8 to rotate.

The circular shield has an outer diameter of 6.77 m, an inner diameter of 6.70 m and a length of 2.00 m; and a plurality of spraying ports are distributed between the outer diameter and the inner diameter, to be used for spraying the expansive soil slurry.

The conical cutterhead includes a cone and excavator bucket type cutters; the cone has a bottom diameter of 6.65 m and a height of 1.0 m; the conical cutterhead is embedded into a groove on an inner wall of the circular shield, sealed by the fine brushes; and the excavator bucket type cutters are distributed on the cone in a cruciform arrangement, and distributed in 4 rings in total with an interval between two rings being 1.0 m.

The mechanical apparatus may effectively increase a tunneling speed and safety for the tunnel in the quicksand stratum, ensure the stability of surrounding rocks of the tunnel, reduce collapse of the quicksand stratum due to tunnel construction, reduce the engineering construction cost and increase the engineering construction speed.

Embodiment 2

A mechanical tunneling process for a tunnel in a quicksand stratum, using the mechanical tunneling apparatuses for the tunnel in the quicksand stratum according to claim 1 for construction, specifically includes the following process steps:

(1) pushing a rear duct piece by a jack to apply propulsive force, pushing the tunneling apparatus forward in turn, and inserting a circular shield into the quicksand stratum in advance to isolate stress and strain transfer between the quicksand strata in the excavation area and the non-excavation area;

(2) pouring, by using the spraying apparatus, the expansive soil slurry into the quicksand stratum from the spraying ports on the inner surface and the outer surface of the shield, so as to make quicksands outside the tunneling apparatus and inside the shield be reinforced and stabilized without being disturbed and destroyed;

(3) driving the cutterhead by the drive apparatus to rotate, effectively segmenting the excavation surface of the quicksand stratum using the conical cutterhead, and excavating and collecting the quicksands using the excavator bucket type cutters, wherein the excavator bucket type cutters communicate with the cutterhead, and the excavator bucket type cutters are capable of making the excavated quicksands enter the cutterhead for collection during excavation;

(4) spraying, by the spraying apparatus, the expansive soil slurry into the cutterhead from the spraying ports inside the cutterhead, so as to make the tunneled quicksand muck in the cutterhead be formed; and (5) conveying, by a screw conveyor, the muck in the cutterhead onto a belt conveyor, and then transporting the muck outside the tunnel.

The construction process may effectively increase a tunneling speed and safety for the tunnel in the quicksand stratum, ensure the stability of surrounding rocks of the tunnel, reduce collapse of the quicksand stratum due to tunnel construction, reduce the engineering construction cost and increase the engineering construction speed.

The above embodiments are merely used for illustration of the technical solutions of the present invention, but not limit them. Although the present invention has been described in detail with reference to the foregoing embodiments, those of ordinary skills in the art should understand that: the technical solutions described in the foregoing embodiments may still be modified, or equivalent substitutions to some of the technical features may be performed. However, these modifications or substitutions do not make the essence of the corresponding technical solutions deviate from the spirit and scope of the technical solutions of the embodiments of the present invention.

What is claimed is:

1. A mechanical tunneling process for a tunnel in a quicksand stratum, using a mechanical tunneling apparatus for the tunnel in the quicksand stratum for construction, the mechanical tunneling apparatus for the tunnel in the quicksand stratum comprising a supporting apparatus, isolating apparatus, an excavation apparatus, a spraying apparatus, a muck discharging apparatus and a propulsion apparatus, wherein the isolating apparatus is arranged at an upper end and a lower end of the supporting apparatus, and used for isolating a quicksand stratum in an excavation area from that in a non-excavation area, and the isolating apparatus comprises a circular shield;

the excavation apparatus is arranged at a front end of the supporting apparatus, and used for excavating and collecting quicksands of an excavation surface of the quicksand stratum, the excavation apparatus comprises a cutterhead and a drive apparatus, the cutterhead is provided with a plurality of cutters, and the cutters communicate with an interior of the cutterhead;

the spraying apparatus is arranged on the isolating apparatus and the excavation apparatus, and used for pouring slurry into the quicksand stratum, the spraying apparatus comprises spraying ports, an inner surface and an outer surface of the circular shield and the interior of the cutterhead are all provided with the spraying ports, and the spraying ports are provided with brushes;

the muck discharging apparatus is arranged at a lower part of the supporting apparatus, and used for conveying muck collected by the excavation apparatus out of the tunnel; and the propulsion apparatus is arranged at a rear end of the supporting apparatus, and used for pushing the tunneling apparatus forward;

the process specifically comprises the following steps:

(1) pushing a rear duct piece by a jack to apply propulsive force, pushing the tunneling apparatus forward in turn, and inserting the circular shield into the quicksand stratum to isolate stress and strain transfer between the quicksand strata in the excavation area and the non-excavation area;

(2) pouring, by using the spraying apparatus, the slurry into the quicksand stratum from the spraying ports on the inner surface and the outer surface of the circular shield, so as to make quicksands outside the tunneling apparatus and inside the circular shield be reinforced and stabilized without being disturbed and destroyed;

(3) driving the cutterhead by the drive apparatus to rotate, effectively segmenting the excavation surface of the quicksand stratum using the conical cutterhead, and excavating and collecting the quicksands using the cutters, wherein the cutters communicate with the cutterhead, and the cutters are capable of making excavated quicksands enter the cutterhead for collection during excavation;

(4) spraying, by the spraying apparatus, the slurry into the cutterhead from the spraying ports inside the cutterhead, so as to make tunneled quicksand muck in the cutterhead be formed; and (5) conveying, by a screw conveyor, the muck in the cutterhead onto a belt conveyor, and then transporting the muck outside the tunnel.

2. The mechanical tunneling process for the tunnel in the quicksand stratum according to claim 1, wherein the circular shield has an outer diameter of 6.77 m, an inner diameter of 6.70 m and a length of 2.00 m; and a plurality of spraying ports are formed between the outer diameter and the inner diameter.

3. The mechanical tunneling process for the tunnel in the quicksand stratum according to claim 2, wherein the propulsion apparatus is arranged at a rear end of the circular shield; the propulsion apparatus comprises the rear duct piece and the jack; and the rear duct piece is pushed forward by the jack to apply the propulsive force, so as to push the tunneling apparatus forward.

4. The mechanical tunneling process for the tunnel in the quicksand stratum according to claim 1, wherein the drive apparatus comprises a rotating bearing; one end of the rotating bearing is connected with the cutterhead; the rotating bearing may drive the cutterhead to rotate.

5. The mechanical tunneling process for the tunnel in the quicksand stratum according to claim 4, wherein the cutterhead is conical; and the cutters are distributed on the conical cutterhead in a cruciform arrangement, and distributed in 4 rings in total with an interval between two rings being 1.0 m.

6. The mechanical tunneling process for the tunnel in the quicksand stratum according to claim 4, wherein the brushes are arranged between the cutterhead and the circular shield.

7. The mechanical tunneling process for the tunnel in the quicksand stratum according to claim 4, wherein the muck discharging apparatus comprises the screw conveyor arranged in the cutterhead; and the belt conveyor is arranged at an end of the screw conveyor.

* * * * *